US007411342B1

(12) United States Patent
Azzi et al.

(10) Patent No.: US 7,411,342 B1
(45) Date of Patent: Aug. 12, 2008

(54) DEFLECTION UNIT FOR SELF-CONVERGING CATHODE-RAY TUBES WITH REDUCED TRAPEZOID DIFFERENTIAL

(75) Inventors: Nacerdine Azzi, Fontaine les Dijon (FR); Olivier Masson, Culsiry (FR); Sebastien Volatier, Genlis (FR)

(73) Assignee: Thomson Licensing, Boulogne Billancourt (FR)

( * ) Notice: Subject to any disclaimer, the term of this patent is extended or adjusted under 35 U.S.C. 154(b) by 0 days.

(21) Appl. No.: 09/937,275

(22) PCT Filed: Mar. 23, 2000

(86) PCT No.: PCT/EP00/02598

§ 371 (c)(1),
(2), (4) Date: Mar. 4, 2002

(87) PCT Pub. No.: WO00/57448

PCT Pub. Date: Sep. 28, 2000

(30) Foreign Application Priority Data

Mar. 24, 1999 (FR) ..... 99 03655

(51) Int. Cl.
*H01F 7/00* (2006.01)
*H01J 29/70* (2006.01)
*H01J 29/00* (2006.01)
*H01J 29/74* (2006.01)

(52) U.S. Cl. ..... 313/440; 313/364; 313/421; 313/433; 335/213; 335/214; 335/210

(58) Field of Classification Search ..... 313/440–443, 313/426, 420, 413, 433, 76; 335/210, 213, 335/216, 340
See application file for complete search history.

(56) References Cited

U.S. PATENT DOCUMENTS

| | | | | | |
|---|---|---|---|---|---|
| 4,152,685 | A * | 5/1979 | Renders et al. | ..... | 335/213 |
| 4,464,643 | A * | 8/1984 | Meershoek | ..... | 335/213 |
| 4,749,975 | A * | 6/1988 | Tokita et al. | ..... | 335/217 |
| 5,121,028 | A * | 6/1992 | Milili | ..... | 313/440 |
| 5,166,576 | A * | 11/1992 | Roussel et al. | ..... | 313/431 |
| 5,302,927 | A * | 4/1994 | Fourche et al. | ..... | 335/210 |
| 5,854,532 | A * | 12/1998 | Kuwahara et al. | ..... | 313/440 |
| 6,087,768 | A * | 7/2000 | Beirens | ..... | 313/442 |
| 6,166,484 | A * | 12/2000 | Okuyama et al. | ..... | 313/440 |
| 6,577,053 | B1 * | 6/2003 | Azzi et al. | ..... | 313/433 |
| 6,624,560 | B2 * | 9/2003 | Usami | ..... | 313/440 |
| 6,690,105 | B1 * | 2/2004 | Azzi et al. | ..... | 313/433 |

FOREIGN PATENT DOCUMENTS

| | | |
|---|---|---|
| EP | 044 585 A1 | 1/1982 |
| EP | 613 168 A1 | 8/1994 |
| FR | 2 757 681 | 6/1998 |

* cited by examiner

*Primary Examiner*—Sikha Roy
*Assistant Examiner*—Natalie K. Walford
(74) *Attorney, Agent, or Firm*—Joseph J. Laks; Harvey D. Fried; Richard LaPeruta

(57) ABSTRACT

Electromagnetic deflection unit for colour cathode-ray tubes, including a pair of frame deflection coils and a pair of line deflection coils, at least one of these two pairs of coils having the shape of a saddle, each saddle-shaped deflection coil having a rear bundle placed on the side facing the electron gun and a front bundle placed on the side facing the screen, two lateral harnesses of conductors connecting the front bundle to the rear bundle, each lateral harness being characterized in that the external edge of the said lateral harness lies in a radial angular position close to 0° at the rear of the coil and in a radial angular position greater than 5° at the front of the coil, so as to minimize the trapezoid differential error between the red and blue beams.

3 Claims, 5 Drawing Sheets

(SIDE VIEW)

DEFLECTION UNIT FOR SELF-CONVERGING CATHODE-RAY TUBES WITH REDUCED TRAPEZOID DIFFERENTIAL

This application claims the benefit under 35 U.S.C. § 365 of International Application PCT/EP00/02598 filed Mar. 23, 2000, which claims the benefit of French Application No. 99 03655, filed Mar. 24, 1999.

The invention relates to a deflection unit for colour cathode-ray tubes, which unit is also called a deflector and comprises a pair of vertical deflection coils and a pair of horizontal deflection coils in the form of a saddle whose particular shape allows the trapezoid errors to be minimized.

A cathode-ray tube designed to generate colour images generally comprises an electron gun emitting three coplanar electron beams, each beam being intended to excite a luminescent material of the corresponding primary colour (red, green or blue) on the tube's screen.

The electron beams scan the tube's screen under the influence of the deflection fields created by the horizontal and vertical deflection coils of the deflector which is fixed to the neck of the tube. A ring of ferromagnetic material conventionally surrounds the deflection coils so as to concentrate the deflection fields in the appropriate region.

The three beams generated by the electron gun must always converge on the tube's screen or else suffer the introduction of a so-called convergence error which, in particular, falsifies the rendition of the colours. In order to achieve convergence of the three coplanar beams, it is known to use so-called self-converging astigmatic deflection fields; in a self-converging deflection coil, the intensity of the field or the lines of flux which are generated by the horizontal deflection coil are generally in the form of a pincushion at a portion of the coil which is located more to the front of the latter on the tube's screen side. This amounts to introducing, into the distribution of turns constituting the line coil, a large positive 3rd harmonic of the ampere-turn density in front of the coil.

Likewise, the convergence of the beams under the influence of the vertical deflection coils is provided by a distribution of the turns of the vertical deflection coils so that the $3^{rd}$ harmonic of the ampere-turn density is negative at the front of the coils.

Moreover, due to the action of the uniform horizontal and vertical deflection fields, the volume scanned by the electron beams is a pyramid whose apex is coincident with the centre of deflection of the deflector and whose intersection with a non-spherical screen surface presents a geometrical defect called pincushion. This geometrical distortion of the image is greater the greater the radius of curvature of the tube's screen. Self-converging deflectors generate astigmatic deflection fields making it possible to modify the North/South and East/West geometry of the image and, in particular, partially compensate for the North/South pincushion distortion.

Astigmatic field configurations such as those described above may produce aberrations called horizontal trapezoid errors which are manifested on the tube's screen, with respect to a rectangular test pattern, by a blue image that has pivoted with respect to the red image, as illustrated in FIG. 5*a*. It may happen that the arrangements of the conductors making up the horizontal deflection coils chosen for optimizing other parameters (convergence, geometry, etc.) induce high-order deflection field harmonics which introduce, if they are not controlled, trapezoid differentials resulting in a slope inversion of the blue image between the 1 o'clock point and the point representative of the corner of the image at 2 o'clock, as illustrated in FIG. 5*b*.

Moreover, these trapezoid differential problems are associated with the flatness of the screen and with its size; they are all the greater and the more difficult to solve the flatter and larger the said screen.

It is common practice to divide the deflection system into three successive action regions along the main axis of the tube: the rear region closest to the electron gun influences more particularly the coma, the intermediate region acts more particularly on the astigmatism of the deflection field and therefore on the convergence of the red and blue electron beams and, finally, the front region, lying closest to the tube's screen, acts on the geometry of the image which will be formed on the tube's screen.

French Patent 2,757,678 provides a solution for reducing the trapezoid differential when it is a question of preferably reducing the value of the trapezoid to the even point of the horizontal border of the screen, that is to say at 2 o'clock, or else at the corner of the image. To do this, the winding of a horizontal deflection coil must be such that, over a length at least equal to half the length of the main window in the coil, there is a free conductor window in a radial angular direction between 30° and 45°.

This solution is not suitable for reducing the resulting trapezoid differential when the latter is predominantly manifested at the odd point on the border of the screen, that is to say at 1 o'clock.

The object of the present invention is to make it possible, by a particular arrangement of the winding wires of the vertical deflection coils, to generate deflection fields which reduce the trapezoid differential between the odd point and the corner of the screen to an acceptable value.

To do this, the electromagnetic deflection unit for colour cathode-ray tubes according to the invention comprises a pair of vertical deflection coils and a pair of horizontal deflection coils, both pairs having the shape of a saddle, each saddle-shaped deflection coil having a rear bundle on the side facing the electron gun and a front bundle on the side facing the screen, two lateral conductor harnesses connecting the front bundle to the rear bundle, each lateral harness comprising a plurality of groups of conductors, characterized in that the external edge of the lateral harness of at least one pair of saddle-shaped coils lies in a radial angular position greater than 5° at least in the front part of the coil.

Further features and advantages of the invention will become apparent from the description below and from the drawings among which:

Figure 3A:
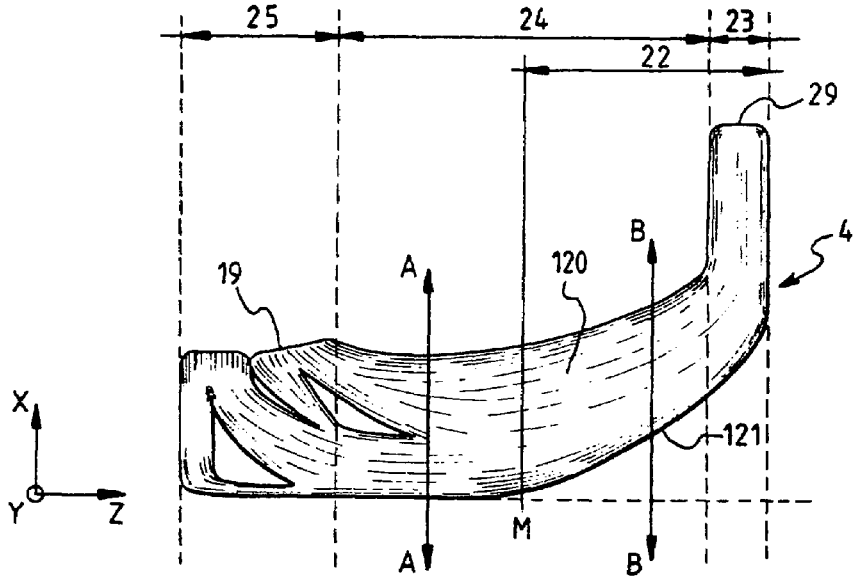
Figure 3B:
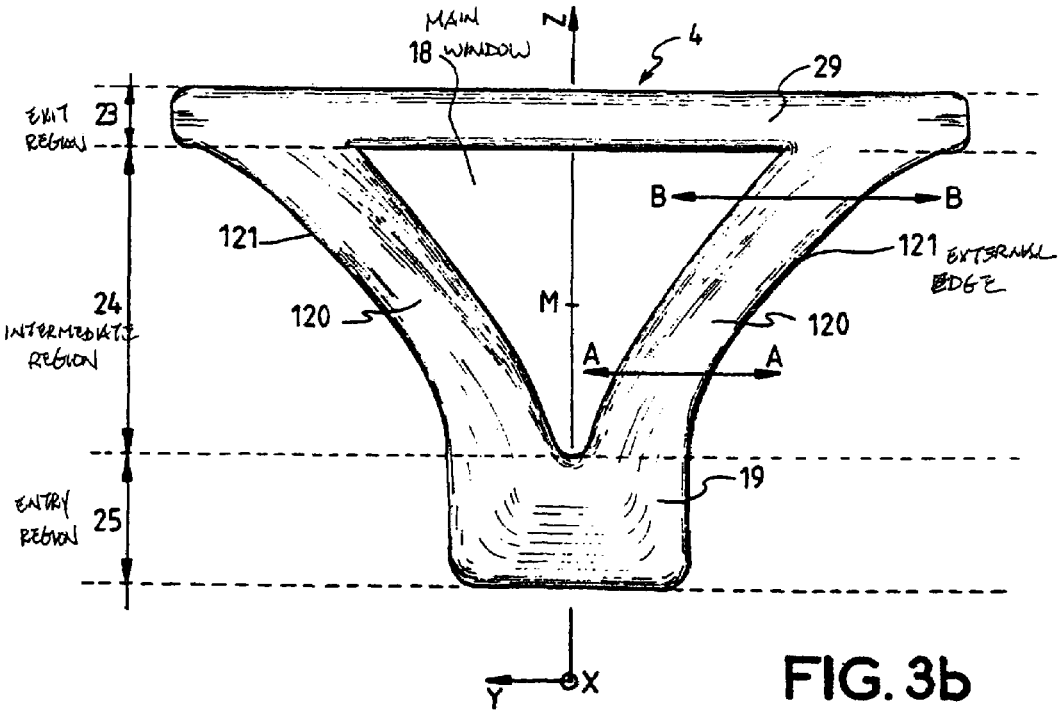
Figure 4A:
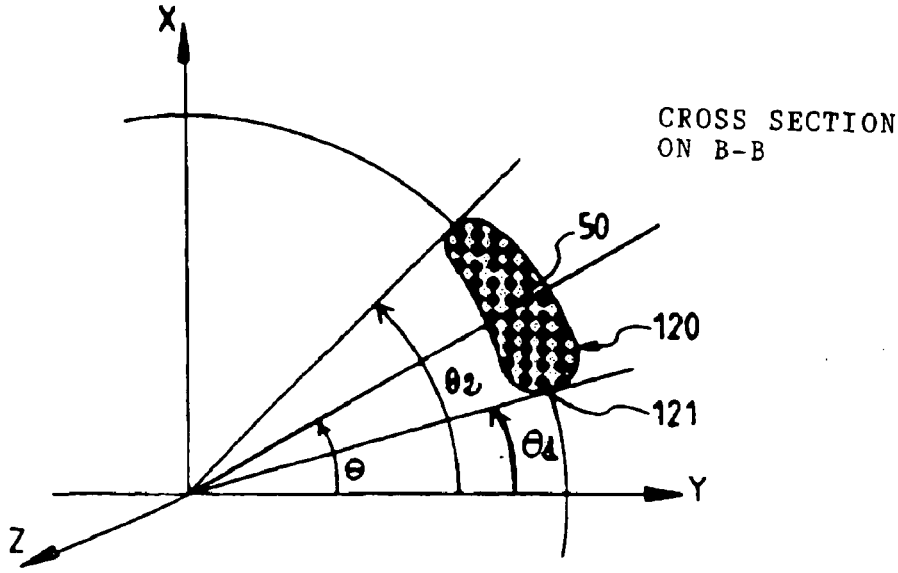
Figure 4B:
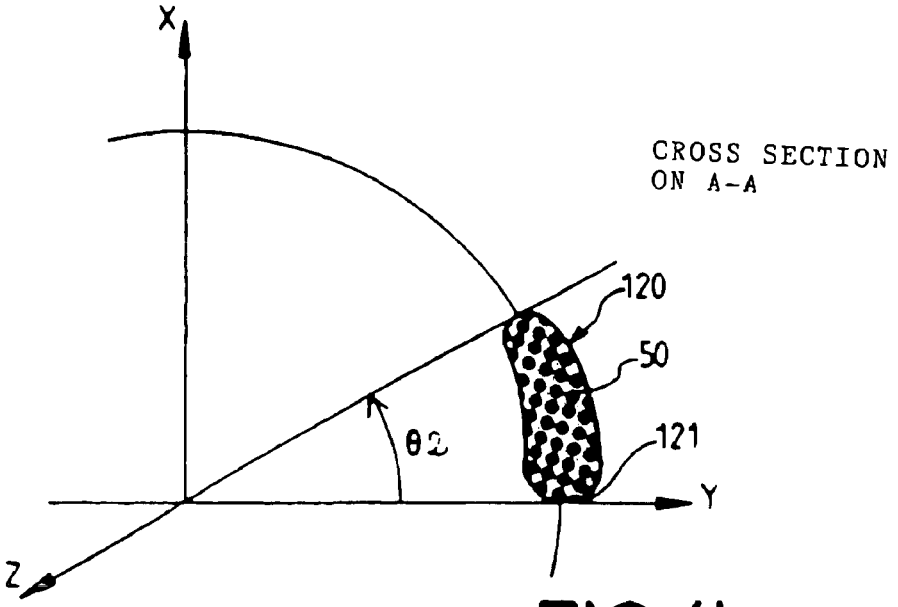
Figure 5A:
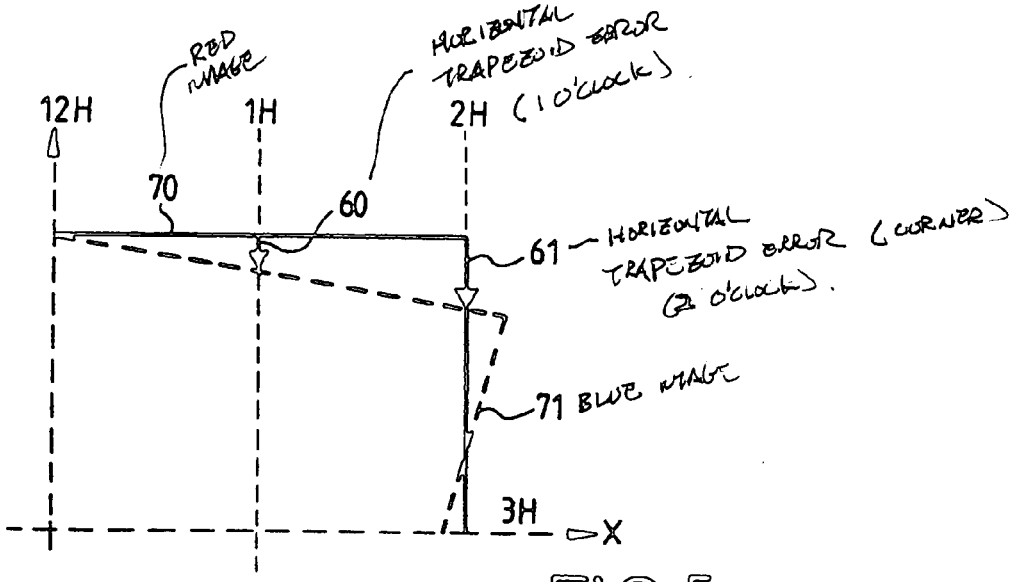
Figure 5B:
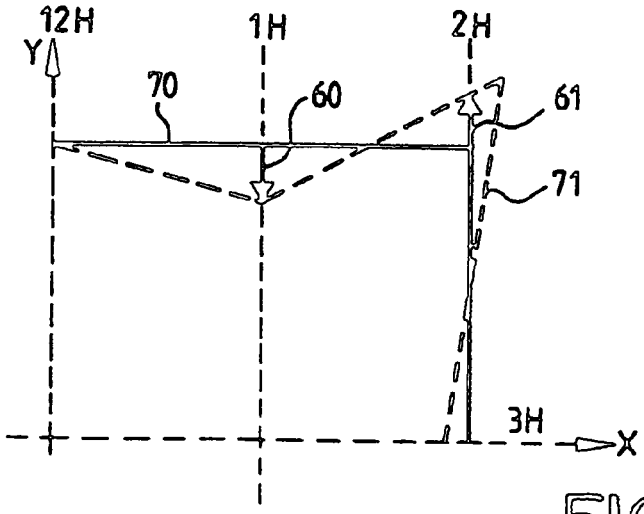
Figure 6:
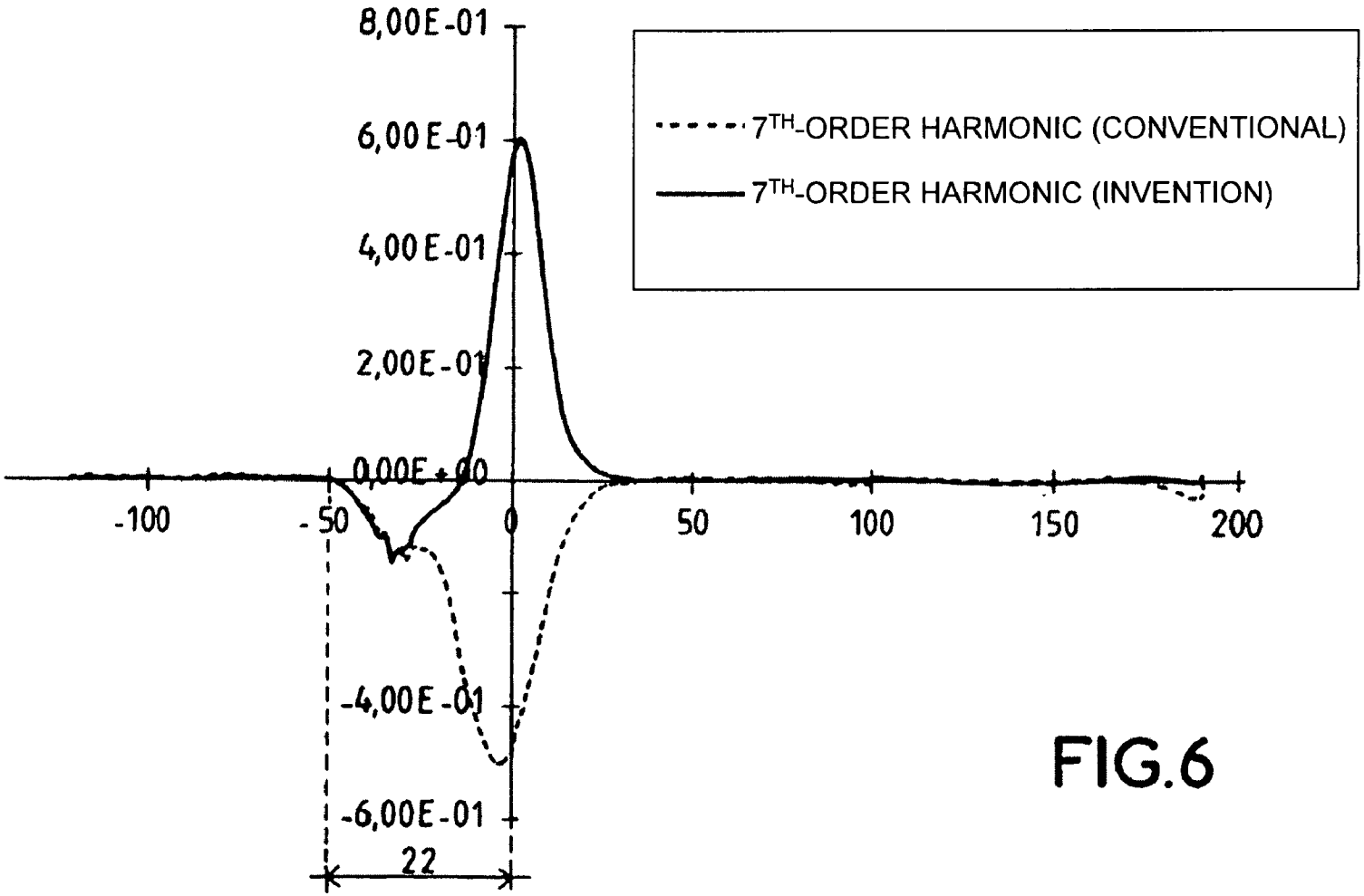

FIG. 3*a* shows a side view of a coil according to the invention and FIG. 3*b* shows a top view of the same coil;

FIGS. 4*a* and 4*b* illustrate a half cross section of a coil according to the invention, made in the front and rear parts of the said coil;

FIGS. 5*a* and 5*b* illustrate two types of trapezoid error between the red and blue images, these errors being due to the astigmatism of the deflection field; and FIG. 6 shows the influence of the invention on the 7th-order harmonic of the potential created by coils according to the invention.

Figure 1:
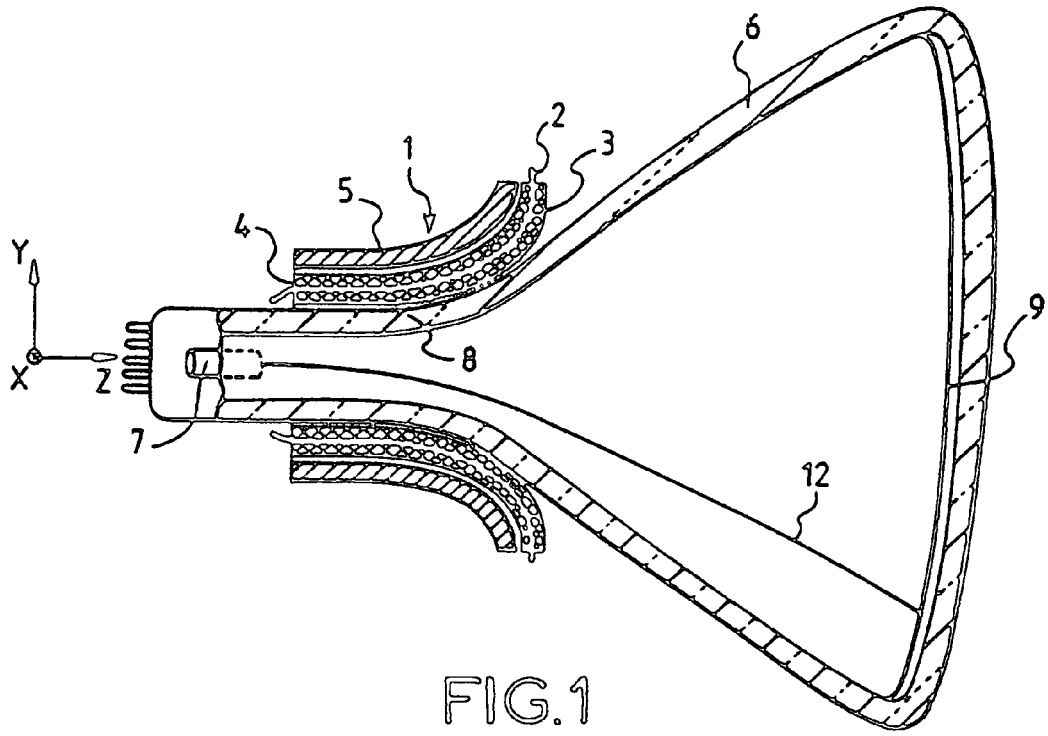
FIG. 1 illustrates a cathode-ray tube equipped with a deflector according to the invention.
Figure 2:
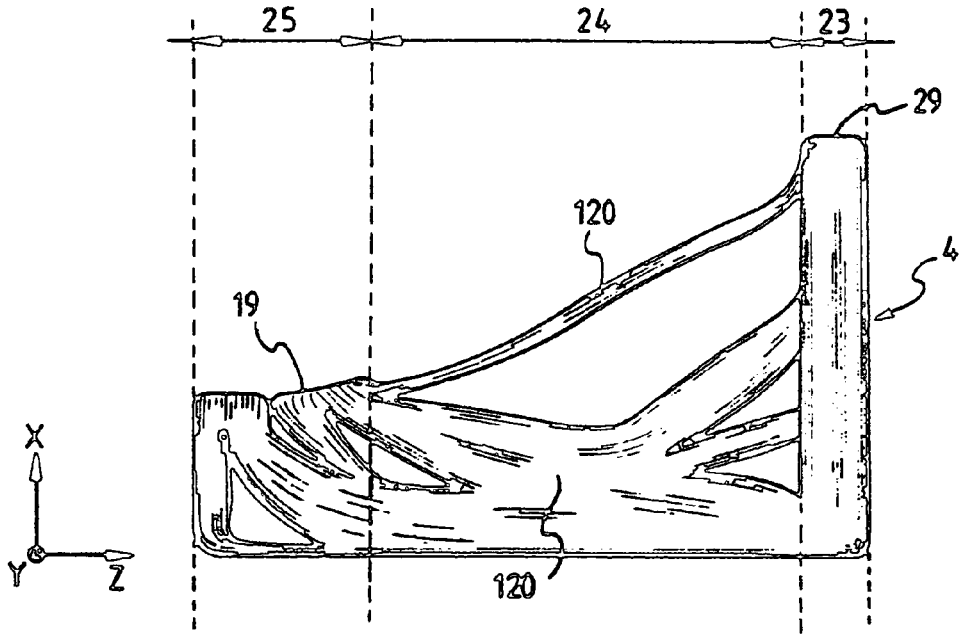
FIG. 2 illustrates an exploded front view of a deflector according to the prior art.

As illustrated in FIG. 1, a self-converging colour display device comprises a cathode-ray tube fitted with an evacuated glass envelope 6 and an array of phosphors representing various colours, these phosphors being arranged at one of the ends of the envelope, forming a display screen 9, and a set of electron guns 7 arranged at a second end of the envelope. The set of electron guns is arranged so as to produce three electron beams 12 aligned horizontally so as to excite, respectively, one of the various colour phosphors. The electron beams scan the entire surface of the screen by means of a deflection system 1, or deflector, which is placed on the neck 8 of the tube and comprises a pair of horizontal deflection coils 3, a pair of vertical deflection coils 4, these being isolated from each other by a separator 2, and a core 5 made of ferromagnetic material intended to concentrate the field at the point where it is designed to act.

Within the context of the invention, the pair of vertical deflection coils of the deflector 1 has a portion 19 called the rear end bundle, close to the electron gun 7. A second portion 29 called the front end bundle of the saddle-shaped coil 3 is close to the display screen 9.

FIG. 3*a* illustrates a side view of one of the pairs of saddle-shaped vertical deflection coils 3 implementing one aspect of the invention. Each winding turn is formed by a loop of conducting wire (50) generally having the shape of a saddle.

The front end bundle 29 of the saddle-shaped coil 3 is connected to the rear end bundle 19 by groups of lateral conductors 120. The bundles 19 and 29 together with the lateral groups of conductors 120 define a main window 18. Taking as reference the direction of flow of the electrons making up the three beams coming from the gun 7, the region over which the window 18 extends is called the intermediate region 24, the region over which the conductors making up the front bundle fan out is called the exit region 23 and that region of the coil which lies to the rear of the window 18, making up the rear bundle, is called the entry region 25. The sections of the lateral elements 120 located in the rear and front parts of the coil are illustrated in FIGS. 4*a* and 4*b*.

Trapezoid is an error due to the astigmatism of the field and is manifested, as illustrated in FIG. 5*a*, by a shift between the red and blue images on the tube's screen; on one quarter of the screen, 70 represents the red image, 71 the blue image, 60 the horizontal trapezoid error at 1 o'clock and 61 the horizontal trapezoid error in the corner at the 2 o'clock point.

When the trapezoid errors are of opposite sign, as is the case illustrated in FIG. 5*b*, the known corrections made in the prior art are unable to provide a solution. These so-called trapezoid differential errors are manifested in particular on substantially curved screens.

French Patent 2,757,678 provides a solution when the corner trapezoid error at 2 o'clock has a greater amplitude than the trapezoid error at 1 o'clock. The solution which is proposed in that patent is to create an aperture in the lateral harnesses 120 of the horizontal deflection coils so as to create a free conductor window in a radial angular direction lying between 30° and 45°. Experience shows that this solution is not very suitable for correcting trapezoid errors when the amplitude of the error at 1 o'clock is the same as the amplitude of the corner error at 2 o'clock.

The invention is aimed at correcting the trapezoid errors by particularly acting on the error at 1 o'clock.

In order to ensure convergence of the electron beams of a cathode-ray tube with three beams in line, it is known that the astigmatism of the vertical field must be such that the 2nd harmonic of the said field has a negative value in the front part of the vertical deflection coils.

Each coil comprises harnesses of conductors 50, the position of each conductor being identified by its radial angular position θ measured with respect to the YZ plane which separates the two vertical deflection coils; the conductors of the group 120 lie between θ1 and θ2, as illustrated in FIGS. 4*a* and 4*b*.

As taught in the literature, a negative 2nd harmonic of the vertical field along the longitudinal axis Z results in barrel-shaped lines of force.

If the current flows in the same direction in all the conductors, the 2nd harmonic is negative if the conductors lie between θ=0° and θ=30°, these values being measured with respect to the YZ plane which separates the coils. By placing the conductors in the gap defined above, it is possible locally to introduce a high degree of negative 2nd harmonic of the field as well as an overall negative amount of 4th harmonic.

In order to maintain convergence of the electron beams coming from an in-line gun, it is known to ensure that the 2nd-order harmonic of the line deflection field is negative in the intermediate region 24 between the rear bundle region 25 and the front bundle region 23. To do this, most of the conductors of the lateral harnesses are, in at least part of the intermediate region 24, maintained in a radial angular position lying between 0° and 30°.

Unlike the prior art, the invention proposes to modify the radial angular position of the lateral conductors in a region 22 lying in front of the coil starting from a point M lying in the intermediate part, so as to modify the ratio of the value of the 2nd harmonic to the values of the higher-order harmonics.

As illustrated in FIGS. 3*a*, 3*b*, 4*a*, 4*b*, the coil according to the invention is such that the external edge 121, in the front part of the coil, no longer lies in the XZ plane, that is to say in a radial angular position equal to zero. Experience shows that in the case of vertical deflection coils, the action on the trapezoid is felt from a radial position of the edge 121 at least equal to 5° in the front part 22.

It is important that the influence of the radial displacement of the conductors for reducing the trapezoid errors is not to the detriment of the other parameters, such as the convergence of the beams or the geometry of the image on the screen. To ensure this, it is preferable at the front of the vertical deflection coil for the radial angular shift of the edge 121 not to exceed 25°. For the same reasons, it is preferable for the length 22 along the Z direction not to exceed half the length of the main window 18 in the coil, which, given the length 23 of the front bundle 29 and the length 25 of the rear bundle 19, amounts to choosing a length 22 within a range not exceeding one third of the length along Z of the deflection coil 4. These limitations apply only if it is desired to have an effect on the trapezoid differential errors without appreciable impact on the values of the other parameters, such as the convergence or the geometry. It is obvious that if preference is given to the correction of the trapezoid errors, it may be necessary to go beyond the above limitations.

The invention has been applied to the design of a deflector for a tube having a 16/9 aspect ratio, the diagonal of the screen face of which being 97 cm, which tube is referred to by the name W97.

For this type of tube, a deflector according to the prior art has an external edge 121 of the vertical deflection coils which lies in the YZ plane along the entire length of the intermediate region 24, the conductors 50 lying in a radial angular position between 0° and 80° with respect to the separating plane YZ. This deflector causes a trapezoid differential problem as indicated in the table below, in which the trapezoid values between the red image and the blue image at nine conventional points representing one quarter of the tube's screen are shown. The trapezoid error measurements are indicated in millimeters:

| 12 o'clock | | 1 o'clock |
|---|---|---|
| | 0.38 | -0.25 |
| | 0.37 | 0.35 |
| | | 3 o'clock |

These coils produce a large trapezoid differential given by $$\Delta_{trap}=(0.38+0.25)=0.63 \text{ mm.}$$

Using the principles of the invention, the vertical deflection coils have been modified. Over a length of 35 mm, equal to 60% of the length of the main window 18, the edge 121 has been brought to a radial angular position of 20°, the conductors 50 lying within this region in an angular window ranging from 20° to 80°.

The red/blue trapezoid error measurements in this case show a great improvement, by reducing the trapezoid at the odd point at 1 o'clock, which brings the trapezoid differential to acceptable values. These values are given in the table below:

| 12 o'clock | | 1 o'clock |
|---|---|---|
| | 0.10 | -0.13 |
| | 0.26 | 0.35 |
| | | 3 o'clock |

$$\Delta'_{trap}=(0.10+0.13)=0.23 \text{ mm.}$$

It should be noted that the invention has the effect of modifying the sign of the 7th harmonic of the potential at the front of the vertical deflection coils according to the invention, this effect being manifested in the amplitude of the trapezoid at the odd point of the screen which it is thus possible to control.

Because of the symmetries of the windings, the ampere-turns density N(θ) of a coil may be expanded as a Fourier series:

$$N(\theta)=\Sigma A_K \cdot \cos(K\theta), \text{ for } K=1, 3, 5, 7, \text{ etc.,}$$

$$\text{with } A_K=(4/\pi)\cdot\int_0^{\pi/2} N(\theta)\cdot\cos(K\theta)\cdot d\theta,$$

where $A_K$ are the winding harmonics. The potential may be expressed as the sum of the ampere-turns from the axis as far as Θ, i.e.:

$$\Phi(R,\Theta)=\int i\cdot N(\theta)\cdot d\theta$$

The scalar potential at a point M in coordinates R, θ may be written as:

$$\Phi(R, \Theta)=\Sigma\Phi_K(R)\cdot\sin(K\cdot\Phi), \text{ for } K=1, 3, 5, 7, \text{ etc.,}$$

where R is the radius of the ferrite magnetic circuit which covers the deflection coils so as to concentrate the fields in order to improve the energy efficiency of the deflection device.

The harmonic of order K has as amplitude: $\Phi_K(R)=(A_K/K)$.

In the prior art illustrated in FIG. 6, the 7th-order harmonic is conventionally negative at the front of the coil because of the arrangement of the turns making up the said coil, the outer edges of the lateral harnesses being located in a radial angular position close to zero. In the case of the invention, illustrated by the solid lines in FIG. 6, the outer edges of the lateral harnesses being over one third of the front part 22 of the coil 4 and lying in a radial angular position close to 20°, it will be noted that there is an inversion of the value of the 7th-order harmonic, which then becomes positive in the corresponding front part of the coil.

What is claimed is:

1. A deflection unit for a colour cathode-ray tube comprising:

a pair of saddle shaped vertical deflection coils extending along a longitudinal axis Z of said tube, the pair of coils comprising a front portion proximal a display screen, a rear portion proximal an electron gun, and a harness portion extending laterally between the front and rear portions and forming a window region there-between, the harness portion defined by an edge extending laterally at a constant first radial angular position of about 0 degrees from the rear portions to a first location within the window region, the edge having a second radial angular position at least about 5 degrees, and not more than about 30 degrees, at a second location within the window region.

2. The deflection unit according to claim 1, wherein the 7th order harmonic of the potential created by the vertical deflection coils is positive at the front of the said coils.

3. The deflection unit of claim 1 wherein the change in radial angular position between the first radial angular position and the second radial angular position is not more than about 25 degrees.

* * * * *